US007552656B2

(12) United States Patent
Miyake

(10) Patent No.: US 7,552,656 B2
(45) Date of Patent: Jun. 30, 2009

(54) INTERMEDIATE GEARED STARTER AND SEAL MEMBER

(75) Inventor: Shinya Miyake, Anjo (JP)

(73) Assignee: Denso Corporation, Kariya (JP)

( * ) Notice: Subject to any disclaimer, the term of this patent is extended or adjusted under 35 U.S.C. 154(b) by 493 days.

(21) Appl. No.: 11/298,854

(22) Filed: Dec. 12, 2005

(65) Prior Publication Data

US 2006/0123935 A1 Jun. 15, 2006

(30) Foreign Application Priority Data

Dec. 13, 2004 (JP) ..... 2004-360253

(51) Int. Cl.
*F02N 15/06* (2006.01)

(52) U.S. Cl. ..... 74/7 R; 74/6

(58) Field of Classification Search ..... 74/6–8
See application file for complete search history.

(56) References Cited

U.S. PATENT DOCUMENTS

| | | | | |
|---|---|---|---|---|
| 5,165,293 | A | 11/1992 | Kittaka et al. | |
| 5,277,075 | A * | 1/1994 | Sakamoto et al. | 74/7 R |
| 6,647,812 | B2 | 11/2003 | Nito et al. | |
| 6,880,415 | B2 | 4/2005 | Nito | |
| 2006/0219032 | A1 * | 10/2006 | Miyake | 74/7 E |

FOREIGN PATENT DOCUMENTS

| | | |
|---|---|---|
| JP | A-61-104163 | 5/1986 |
| JP | B2 08-6664 | 1/1996 |
| JP | A 2002-180937 | 6/2002 |
| JP | A-2002-281711 | 9/2002 |
| JP | A-2002-296223 | 10/2002 |
| JP | A-2002-333380 | 11/2002 |
| JP | A 2003-239834 | 8/2003 |

OTHER PUBLICATIONS

"Notification of Reasons for Rejection", Patent Application No.: 2004-360253, Mar. 17, 2009, 2 pp., Japanese Patent Office, Japan.

* cited by examiner

*Primary Examiner*—Richard W L Ridley
*Assistant Examiner*—James Pilkington
(74) *Attorney, Agent, or Firm*—Oliff & Berridge, PLC

(57) ABSTRACT

An intermediate geared starter is provided, which has a pinion shaft, a pinion gear, an intermediate shaft, an intermediate gear, and a housing. The pinion shaft is rotatable upon receipt of a rotational force from a motor and the pinion gear is supported on the pinion shaft. The intermediate shaft is disposed in parallel to the pinion shaft and the intermediate gear is carried by the intermediate shaft and held in meshing engagement with the pinion gear at all times. Further, the housing has a through-bore, to which the intermediate shaft is inserted, which supports one end of the intermediate shaft inserted to the through-bore. The housing has a seal member adapted to block a sliding clearance, which is created between the through-bore and an axial distal end of the intermediate shaft, from the outside of the starter.

19 Claims, 7 Drawing Sheets

INTERMEDIATE GEARED STARTER AND SEAL MEMBER

CROSS REFERENCE TO RELATED APPLICATION

The present application relates to and incorporates by reference Japanese Patent application No. 2004-360253 filed on Dec. 13, 2004.

BACKGROUND OF THE INVENTION

1. Technical Field of the Invention

The present invention relates to starters for use in starting up internal combustion engines of vehicles and, more particularly, to an intermediate geared starter having an intermediate gear, held in meshing engagement with a pinion gear at all times, which is moved into meshing engagement with a ring gear of an engine for startup thereof.

2. Related Art

In general, an internal combustion engine of a vehicle is started up by a starter that is supplied with electric power from an on-vehicle battery for rotation. As one type of the starter, an intermediate geared starter is known. FIG. 1 shows an example of the intermediate geared starter of the related art.

As shown in FIG. 1, the intermediate geared starter is comprised of a pinion shaft 110 carrying thereon a pinion gear 100, an intermediate shaft 120 disposed in parallel to the pinion shaft 110, and an intermediate gear 130 carried on the intermediate shaft and held in meshing engagement with the pinion gear 100 at all times. Upon movements of both the intermediate gear 130 and the pinion gear 100 in an axial direction to cause the intermediate gear 130 to be brought into meshing engagement with the ring gear 140 of the engine, a rotational force is transferred from the pinion gear 100 to the ring gear 140 via the intermediate gear 130 to start up the engine.

However, the intermediate shaft 120 is inserted and assembled to a through-bore 160 formed in a nose portion 150 of a housing to allow the through-bore 160 to support one end of the intermediate shaft 120. With such a structure, the intermediate shaft 120 is fitted to the through-bore 120 with a clearance. That is, since the through-bore 160 has an inner diameter slightly greater than an outer diameter of the intermediate shaft 120 to a degree enabling the intermediate shaft 120 to be inserted, a sliding clearance is created between the one end of the intermediate shaft 120 and the through-bore 160. Therefore, foreign materials, such as dust, enter the sliding clearance from an area (at a rightward area in FIG. 9) outside the nose portion 150 and as the foreign materials reach the intermediate gear 130 to an area between the intermediate shaft 120 and the intermediate gear 130, there is a fear of inability for the intermediate gear 130 to smoothly move on the intermediate shaft 120.

SUMMARY OF THE INVENTION

The present invention has been completed with the above issues in mind and has an object to provide an intermediate geared starter that prevents entry of foreign materials through a sliding clearance of a through-bore, to which one end of an intermediate shaft is inserted, for thereby enabling smooth movement of an intermediate gear.

One aspect of the present invention provides an intermediate geared starter having a pinion shaft rotatable in receipt of a rotational force from a motor, a pinion gear supported on the pinion shaft, an intermediate shaft disposed in parallel to the pinion shaft, an intermediate gear, supported on the intermediate shaft in meshing engagement with the pinion gear at all times, and a housing, formed with a through-bore for insertion of the intermediate shaft, by which one distal end of the intermediate shaft inserted to the through-bore is supported. The intermediate gear is axially moved together with the pinion gear to be brought into meshing engagement with a ring gear of an engine to transfer a rotational force from the pinion gear to the rig gear via the intermediate gear for starting up the engine. The housing has a seal member to block a sliding clearance, created between the through-bore and the distal end of the intermediate shaft, from an outside of the starter. Thus foreign materials can be blocked from getting into the sliding clearance from the outside of the starter. When the intermediate gear moves (slides) on the intermediate shaft, the intermediate gear is able to smoothly move on the intermediate shaft without causing the foreign materials to inhibit the movement of the intermediate gear.

Preferably, the housing has an abutment surface, to be brought into abutting contact with a mount surface of the engine or an engine support member, which is formed in parallel to the intermediate shaft and a bearing portion protruding toward the engine at a position displaced from a distal end of the abutment surface on a plane substantially perpendicular to the abutment surface. The through-bore is formed in the bearing portion so as to extend through the bearing portion from the abutment surface across an area, straddling one side closer to the engine and the other side opposing to the engine, and a portion between the bearing portion and a distal end of the housing, is formed only in an area far from the abutment surface in a direction in a direction coming away from the engine to play a role as a mount aperture to which the seal member is mounted. The seal member includes an insertion segment, adapted to be inserted to the mount aperture for hermetically sealing capability, and a thin-walled tong segment, extending on a plane substantially perpendicular to the abutment surface and to be brought into contact with an end face of the bearing portion, both of which are integrally made of a resilient body to allow the insert segment and the tong segment to cooperate each other for blocking the sliding clearance from an outside. Accordingly, even the intermediate geared starter has the bearing portion structured as above, the seal member can be mounted with steadiness without interference with the engine-side mount surface.

It is preferred that the seal member has a structure wherein the tong segment is tapered from the insert segment toward an end face of the bearing portion whereby when the insert segment is inserted through the mount aperture to a predetermined position thereof, the tong segment is resiliently brought into abutting contact with the end face of the bearing portion. Thus a high sealing performance can be given.

Preferably, the insert segment of the seal member is formed in a substantially half-column configuration corresponding to a cross sectional shape of the mount aperture and has a flat surface, exposed from the mount aperture, which is formed at the same height as that of the abutment surface under a status where the seal member is inserted to the mount aperture. Thus, when the starter is installed to the engine body, the flat surface of the insert segment can tightly be contacted to the engine-side mount surface, so that the seal member can be prevented from becoming bumpy.

Preferably, the through-bore has a radial center position dislocated from the abutment surface at a position in a direction coming away from the engine. Preferably, the seal member has a protrusion formed on the insert segment at an outer periphery thereof and an inner circumferential periphery of the mount aperture has a recessed portion to which the protrusion is fitted.

Preferably, the protrusion, formed on the outer periphery of the insert segment, has an inverse tapered configuration with a circumferential width gradually increasing along a height direction of the protrusion. The recessed portion, formed on the inner circumferential periphery of the mount aperture, has an inverse tapered configuration with a circumferential width gradually increasing along a depth direction of the recessed portion.

It is also preferred that a thin-plate-like gasket is mounted on the abutment surface for preventing the seal member from dropping off. Preferably, the seal member is formed of a circular-column shaped resilient body adapted to be press fitted to the through-bore to block the sliding clearance from an outside. Still preferably, the seal member is mounted under a status in contact with the end face of the bearing portion inserted to the through-bore.

DETAILED DESCRIPTION OF PREFERRED EMBODIMENTS

Now, intermediate geared starters of various embodiments according to the present invention will now be described with reference to the accompanying drawings.

First Embodiment

Figure 1:
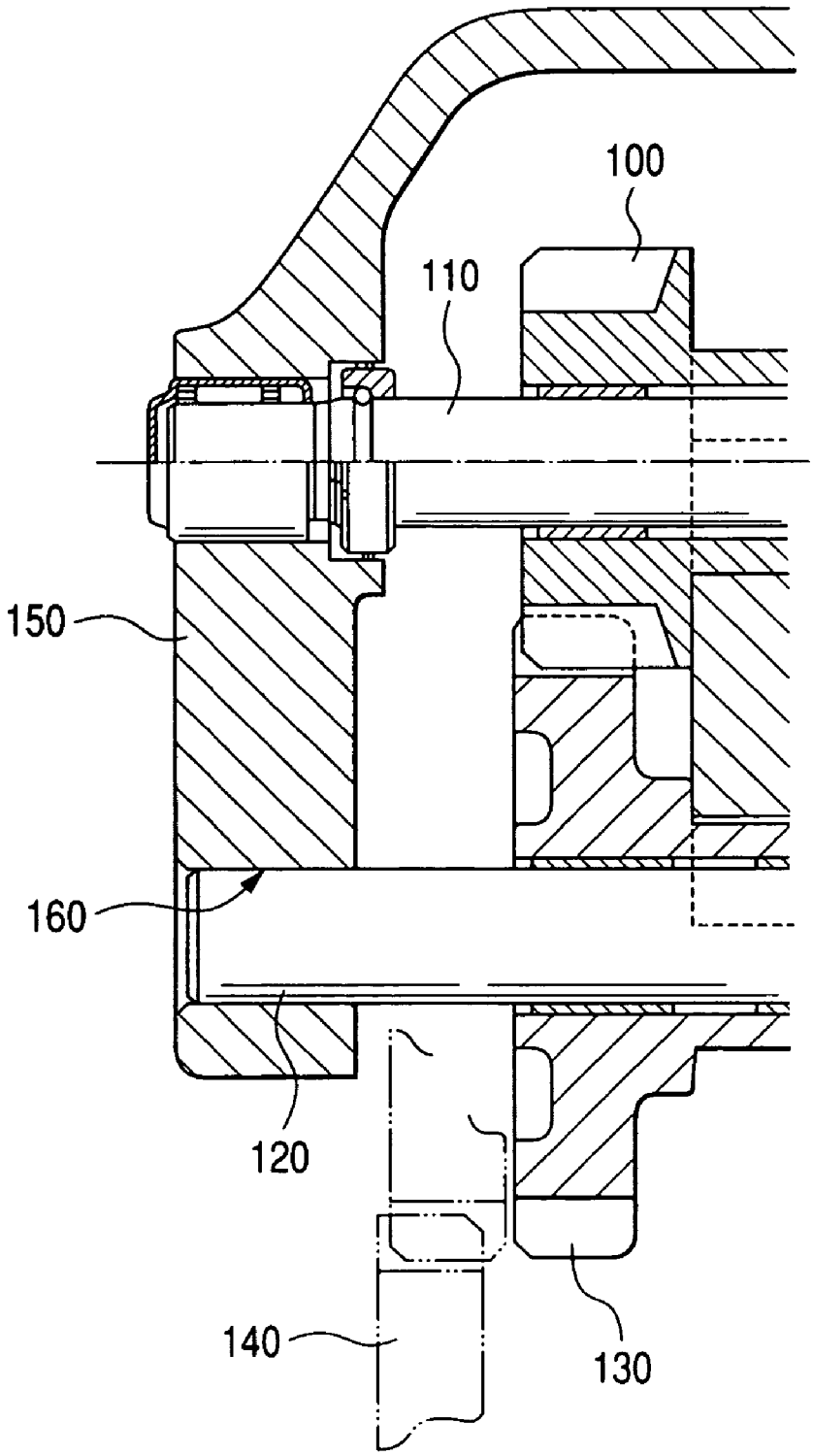
FIG. 1 (PRIOR ART)
FIG. 1 is a cross sectional view showing an essential part of an intermediate geared starter of the related art.
Figure 2:
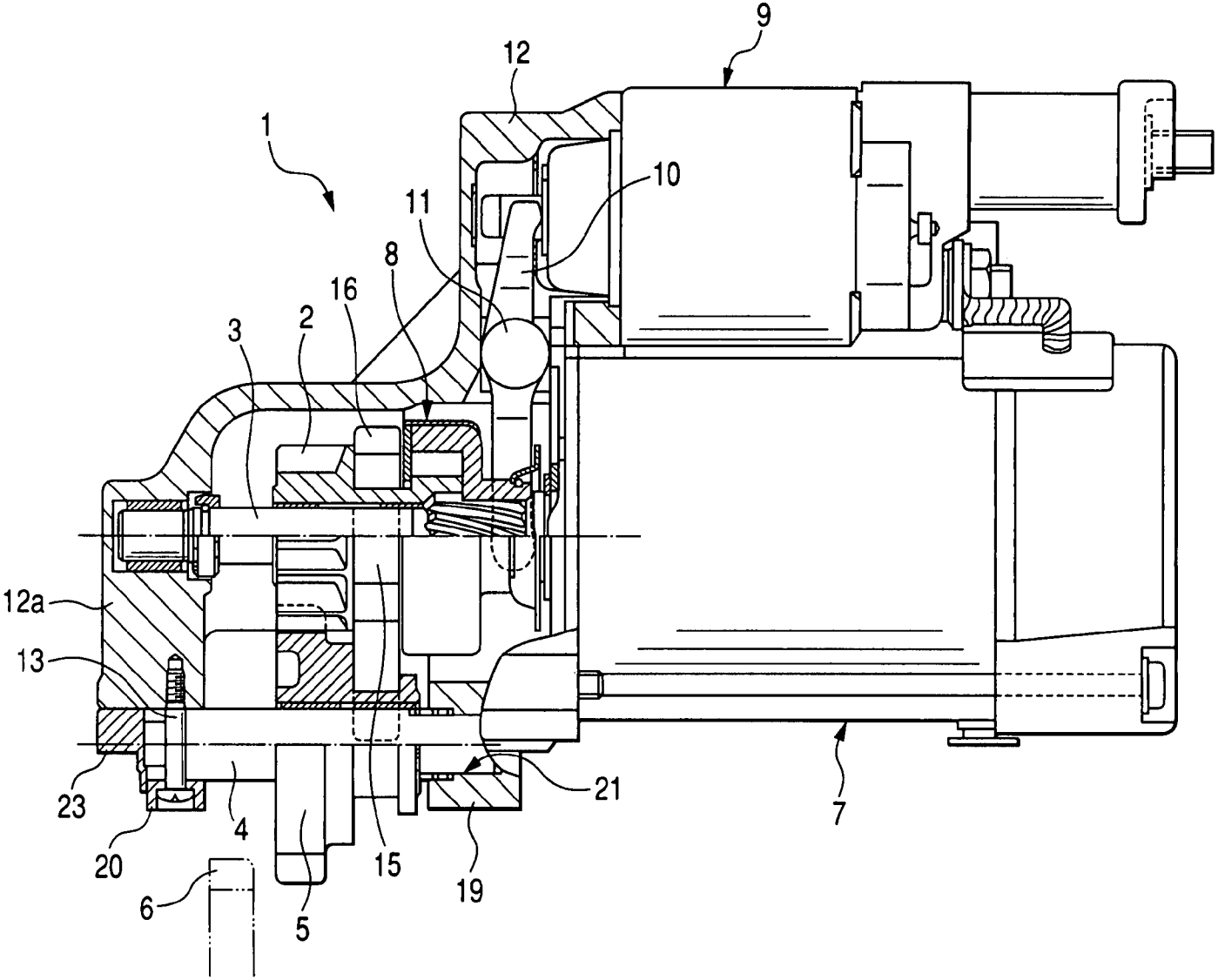
FIG. 2 is a side view, partly in cross section, of an intermediate geared starter of a first embodiment according to the present invention.

First, referring to FIGS. 2 to 6, description is made of an intermediate geared starter of a first embodiment according to the present invention. As shown in FIG. 2, the intermediate geared starter 1 according to the present invention takes the form of a system that is comprised of a pinion shaft 3, on which a pinion gear 2 is supported, an intermediate shaft 4 disposed in parallel to the pinion shaft 2, and an intermediate gear 5 supported on the intermediate shaft 4 with the intermediate gear 5 and the pinion gear 2 being axially moveable to be brought into meshing engagement with a ring gear 6 of an engine.

The pinion shaft 3 is disposed in coaxial relationship with a rotational shaft (not shown) of a motor 7 to allow a rotational force to be transmitted from the motor 7 through a gear reduction unit (such as, for instance, a planetary gear set) that is not shown.

The rotation of the pinion shaft 2 is transmitted via a clutch 8 to the pinion gear 2, which is integrally moveable with the clutch 8 on the pinion shaft 3.

The clutch 8 takes the form of one-way clutch wherein the dutch 8 is coupled to an outer periphery of the pinion shaft 3 through helical splines to transfer the rotation of the pinion shaft 3 to the pinion gear 2 while interrupting power transfer between relevant component parts when a drive power of the engine is transmitted to the pinion gear 2, that is, when a rotational speed of the pinion gear 2 exceeds a rotational speed of the pinion shaft 3.

The motor 7 includes, for instance, a direct current motor and as motor contacts (not shown), to which an electric circuit of the motor 7 is connected, are operatively closed by an electromagnetic switch 9, an on-vehicle battery turns on an armature (not shown) to generate a rotational force.

The electromagnetic switch 9 has a function of operatively opening or closing the motor contacts while axially moving the clutch 8 through a shift lever 10.

The shift lever 10 is swingably supported about a center of a fulcrum 11 and transfers the movement of a plunger (not shown), incorporated in the electromagnetic clutch 9, to the clutch 8.

The intermediate shaft 4 has both ends supported by a housing 12 and is fixedly secured thereto by means of a screw 13 for non-rotation.

The intermediate gear 5 is rotatably supported by an outer periphery of the intermediate shaft 4 by means of a bearing 4 in meshing engagement with the pinion gear 2 at all times. Further, the intermediate gear 5 is connected through an engagement member 16 to a cylindrical member 15 through which the pinion gear 2 and the clutch 8 are connected. With such a structure, as the pinion gear 2 and the clutch 8 move on the pinion shaft 3, the intermediate gear 5 moves on the intermediate shaft 4 in an axial direction while remaining in meshing engagement with the pinion gear 2.

The housing 12 has an abutment surface 18 (see FIGS. 3 and 4), to be held in abutting contact with a mount surface 17 (see FIG. 4) formed on the engine (at an area of, for instance, a transmission case), which is formed in parallel to the intermediate shaft 4. As can be shown in FIG. 4, using the abutment surface 18 as a border, there can be provided two delineated areas composed of a nearer-to-engine side area which is nearer to the engine compared to the abutment surface 18 and a farther-from-engine side area which is farther from the engine compared to the abutment surface 18.

The abutment surface 18 is formed with an opening to allow the intermediate gear 5 to be brought into meshing engagement with the ring gear 6 of the engine, with a substantially radial half of the intermediate gear 5 being exposed to an area outside the abutment surface 18.

Further, the housing 12 has first and second bearing portions 19, 20, formed on both sides of the opening in an axial direction, by which the intermediate shaft 4 is supported.

Figure 3:
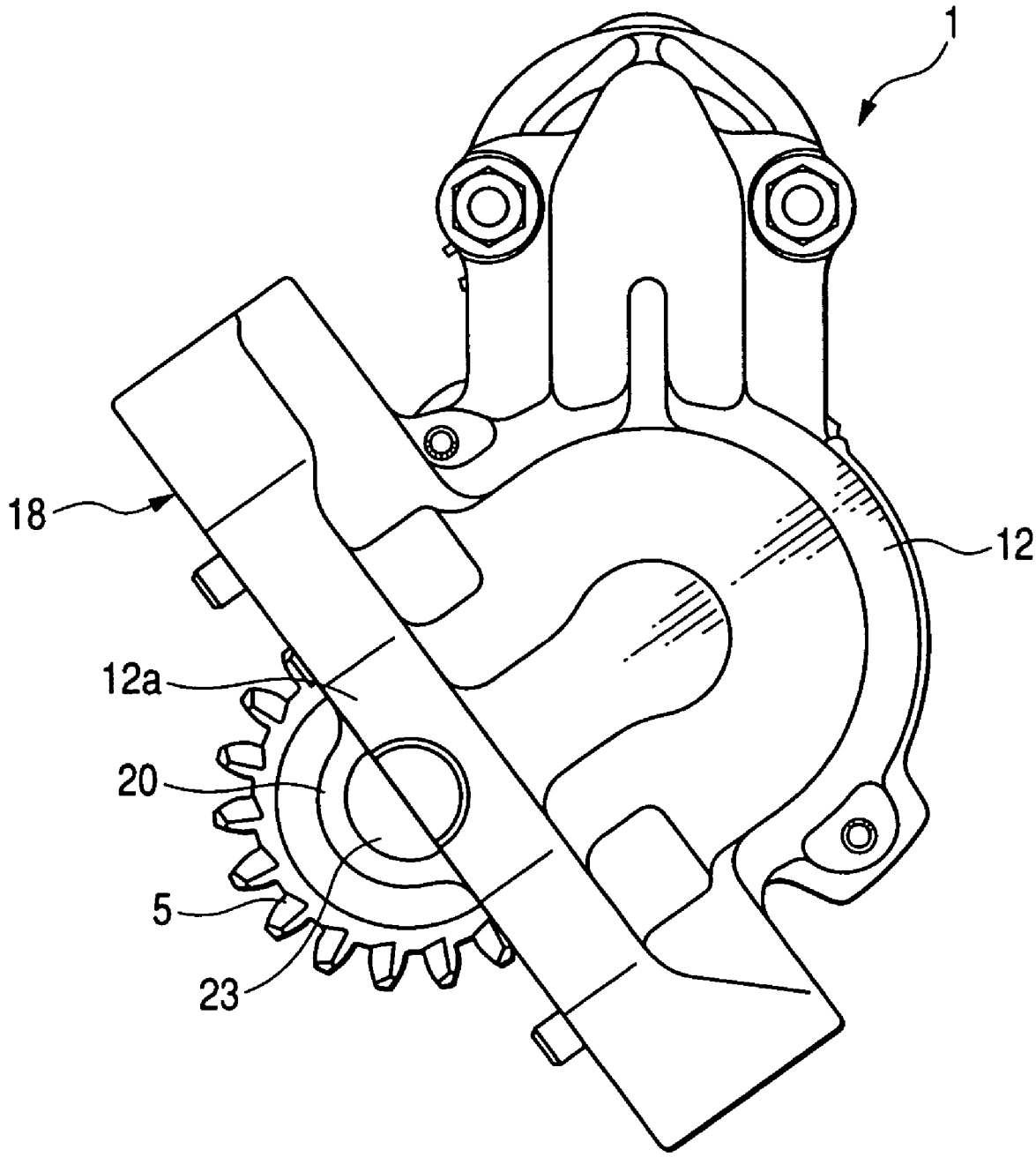
FIG. 3 is a partial side view of the intermediate geared starter.
Figure 4:
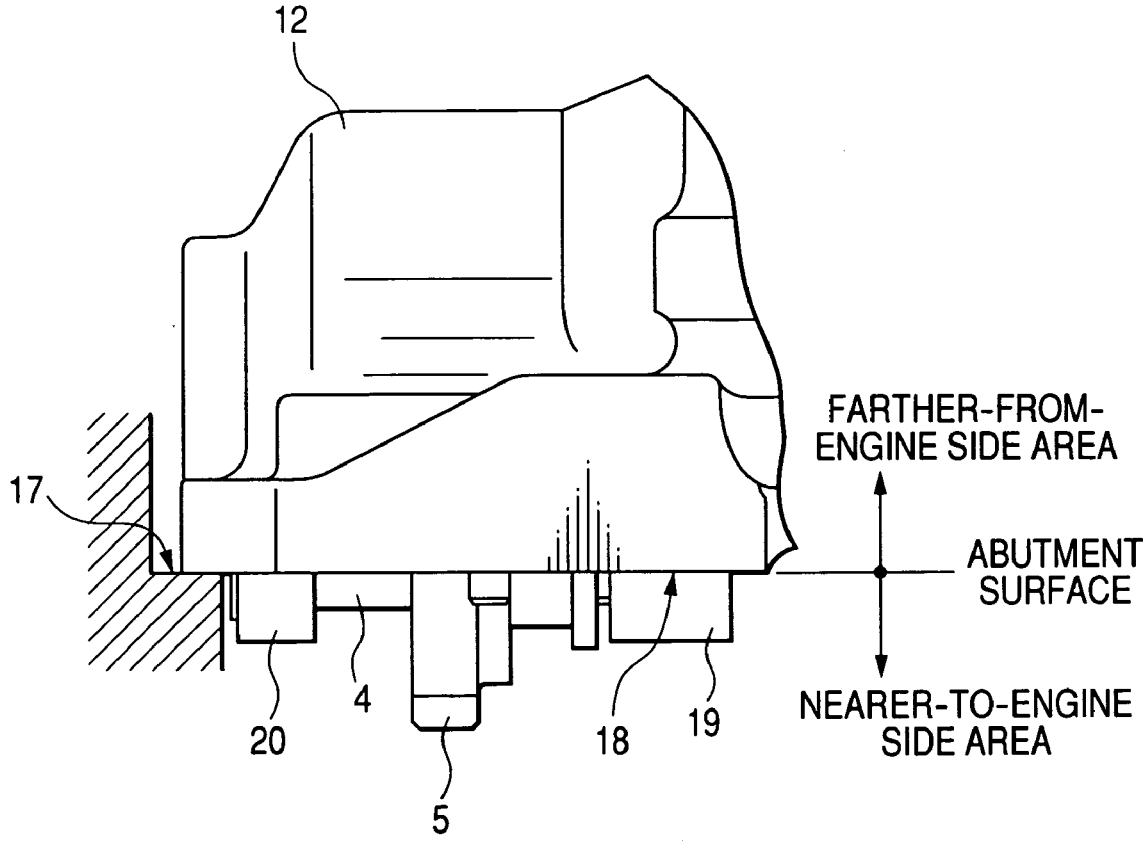
FIG. 4 is an axial front view of the intermediate geared starter.

The first and second bearing portions 19, 20 support the intermediate shaft 4 such that the abutment surface 18 is positioned at a central area in a radial direction of the intermediate shaft 4. In other words, the intermediate shaft 4 is supported under conditions wherein the substantially radial half of the intermediate shaft 4 is located inward (at a position in the farther-from-engine side area) of the abutment surface 18 and the remaining half is located outside the abutment surface 18 (at a position in the nearer-to-engine side area). Accordingly, the first and second bearing portions 19, 20 protrude outward (at positions in the nearer-to-engine side area) of the abutment surface 18 of the housing 12 as shown in FIG. 3.

Figure 5:
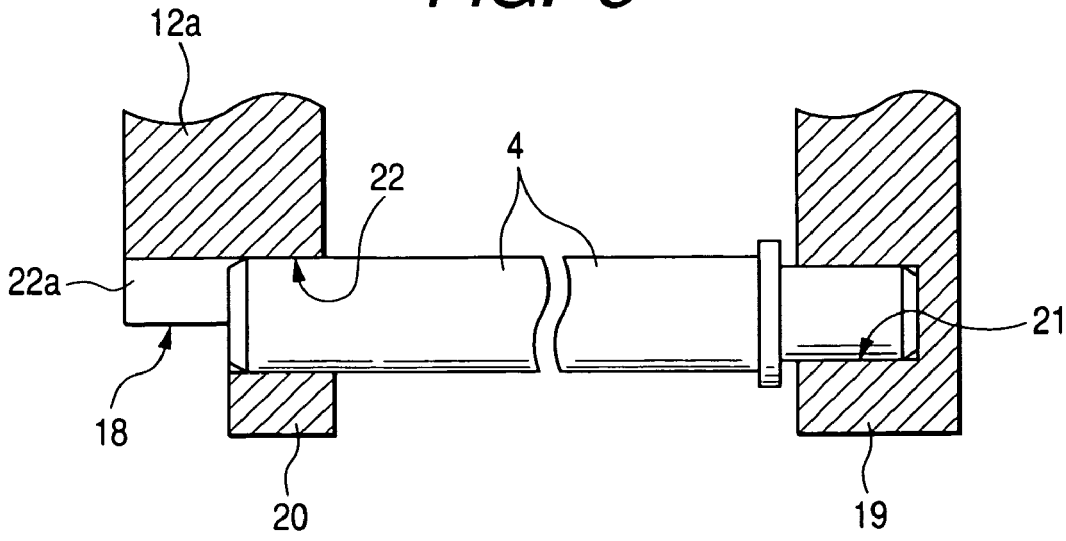
FIG. 5 is an enlarged cross sectional view of first and second bearing portions.

The bearing portion 19 is formed with an insertion bore 21, circular in cross section, which supports an end, closer to the motor, of the intermediate shaft 4. Also, as shown in FIG. 5, the insertion bore 21 does not penetrate through the first bearing portion 19 in an axial direction thereof (in a lateral direction in FIG. 5) and is bored at one end face, opposite to the motor, toward the other end face (in a direction from a leftward to a rightward in FIG. 5), closer to the motor, which is closed.

The second bearing portion 20 is formed on a nose portion 12*a* of the housing 12, by which a distal end, opposite to the motor, (an axial end of the present invention) of the pinion shaft 3, is supported, and has a through-bore 22 (se FIG. 5), axially extending through the nose portion 12*a*, by which one end, opposite to the motor, of the intermediate shaft 4 is supported.

However, the second bearing portion 20 is not formed in an axially entire area of the nose portion 12*a* but formed in a position axially rearward (rightward in FIG. 5) of a leading end face of the nose portion 12*a*. That is, the nose portion 12*a* has the abutment surface 18 formed at an area in front of the second bearing portion 20, which is formed in a way to protrude toward the engine along a plane substantially perpendicular to the abutment surface 18. Consequently, the through-bore 22 is not formed in a rounded bore, circular in cross section, at an area (an area in which the abutment surface 18 is formed) starting from the second bearing portion 20 to the leading end face of the nose portion 12*a* and has a shape that is substantially semicircular in cross section to be open to the abutment surface 18.

The intermediate shaft 4 is assembled to the through-bore 22, formed in the nose portion 12*a*, to which a seal member 23, described below in detail, is subsequently mounted. Also, the intermediate shaft 4 passes across the through-bore 22 from an area outside the nose portion 12*a* and is inserted to an inside of the housing 12 to allow one end, closer to the motor, to be fitted to the insertion bore 21 for support by the first bearing portion 19 while the other end, opposite to the motor, is supported by the second bearing portion 20 under a status fitted in part of the through-bore 22. When this takes place, as shown in FIG. 5, the other end of the intermediate shaft 4 does not protrude from the second bearing portion 20 and has an end face substantially aligned on the same plane as that of an end face (an end face substantially perpendicular to the abutment surface 18) of the second bearing portion 20.

Figure 6A:
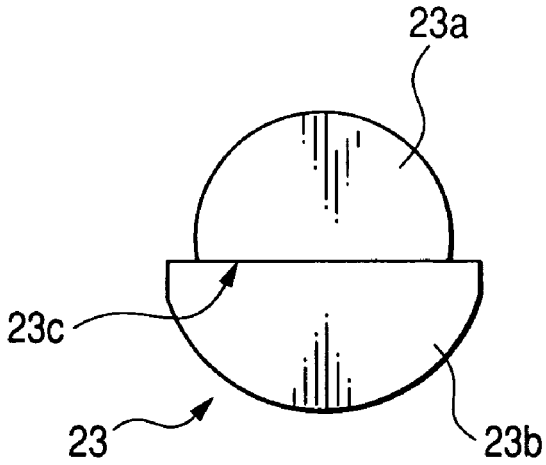
FIG. 6A is a front view of a seal member related to the first embodiment.
Figure 6B:
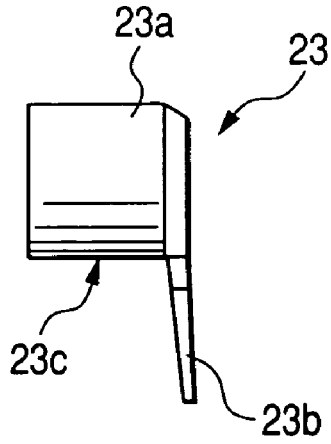
FIG. 6B is a side view of the seal member.

The seal member 23 is comprised of an insert segment 23*a*, hermetically inserted to an area substantially semicircular in cross section of the through-bore 22 formed on the nose portion 12*a*, that is, an area (hereinafter referred to as a mount aperture 22*a*) formed on the distal end of the nose portion 12*a* at an area far from the second bearing portion 20, and a thin-walled tong segment 23*b* to be brought into abutting contact with the end face of the second bearing portion 20, with the insert segment 23*a* and the tong segment 23*b* being shown to be integrally formed of a resilient body (of, for instance, rubber) as shown in FIGS. 6A and 6B.

The insert segment 23*a* has a substantially semicircular shape, corresponding to a cross sectional shape of the mount aperture 22*a*, and a flat surface 23*c*, exposed from the mount aperture 22*a*, which is formed in the same height as that of the abutment surface 18 of the nose portion 12*a*.

The tong segment 23*b*, formed on the insert segment 23*a* at the same side as the flat surface 23*c* and at a distal end of the insert segment 23*a* in an inserting direction, has a semicircular configuration with radius greater than that of an outer circumferential shape of the insert segment 23*a*. Also, as shown in FIG. 6B, the tong segment 23*b* has an end face tapered from the insert segment 23*a* toward the end face of the second bearing 20 (rightward in FIG. 6B). This enables the tong segment 23*b* to be brought into abutting engagement with the end face of the second bearing portion 20 with a resilient force being applied under a situation in which the insert segment 23*a* is inserted to the mount aperture 22*a* at a predetermined position thereof.

Now, description is made of operation of the intermediate geared starter 1.

As an attraction force (a force attracting the plunger) of the electromagnetic switch 9 is transferred through the shift lever 10 to the clutch 8, the pinion gear 2 and the clutch 8 shift on the pinion shaft 3 in a direction opposite to the motor and in synchronism with the movement of the pinion gear 2, the intermediate gear 5 moves on the intermediate shaft 4 while remaining in meshing engagement with the pinion gear 2. In the meanwhile, if the motor contacts are closed by the action of the electromagnet switch 9, electric power is supplied from the on-vehicle battery the motor 7 to turn on the motor 7 causing the armature to create a rotational force. The rotational force is transferred through the gear reduction unit to the pinion shaft 3, through which the rotational force is further delivered to the pinion gear 2 via the clutch 8.

Upon meshing engagement of the intermediate gear 5 with the ring gear 6, the rotational force is transferred from the pinion gear 2 to the ring gear 6 via the intermediate gear 5, causing the ring gear 6 to rotate cranking the engine.

If the magnetic force of the electromagnet switch 9 is distinguished after the engine has started up, the plunger is restored due to a reaction force of a return spring (now shown) incorporated in the electromagnet switch 9. The restoring force, acting on this plunger, is delivered to the clutch 8 via the shift lever 10, the pinion gear 2 and the clutch 8 move on the pinion shaft 3 in a direction toward the motor, causing the intermediate gear 5 to move on the intermediate shaft 4 in a direction (rightward in FIG. 2) away from the ring gear 6 for disengagement. In the meanwhile, upon operation of the electromagnet switch 9 to open the motor contacts, the motor 7 is turned off, thereby stopping the rotation of the armature.

With the intermediate geared starter 1 set forth above, the intermediate shaft 4 is inserted to the through-bore 22, formed in the nose portion 12*a* of the housing 12, for assembly and subsequently, the through-bore 22 can be hermetically sealed by the seal member 23. That is, inserting the insert segment 23*a* of the seal member 23 to the mount aperture 22*a* enables the mount aperture 22*a* to be closed in a hermetic sealing effect. Further, pressing the tong segment 23*b*, integrally formed with the insert segment 23*a*, against the end face of the second bearing portion 20 enables the opening of the through-bore 22, opening to the end face of the second bearing portion 20, to be closed. This results in a capability of preventing foreign materials from entering a sliding clearance of the through-bore 22 from the outside of the housing 12. Thus, during a phase wherein the intermediate gear 5 moves (slides) on the intermediate shaft 4, the intermediate gear 5 is able to move on the intermediate shaft 4 without causing the foreign materials to inhibit the movement of the intermediate gear 5.

Further, the distal end, opposite to the motor, of the intermediate shaft 4 is inserted to and assembled to the through-bore 22 of the housing 12 such that it does not protrude from the second bearing portion 20 and the distal end, opposite to the motor, of the intermediate shaft 4 has an end face aligned on the substantially same position as that of an end face (substantially perpendicular to the abutment surface 18) of the second bearing portion 20. This enables the seal member 23 to be mounted to the mount aperture 22*a* under a status with no clearance created with respect to the distal end, opposite to the motor, of the intermediate shaft 4 while permitting an end face of the insert segment 23*a* and a surface of the tong segment 23*b* to remain in contact with the end face, opposite to the motor, of the intermediate shaft 4. In this case, a resonant frequency of the intermediate shaft 4 varies when applied with engine vibrations, causing reduction in fretting frictions that would occur on the intermediate shaft 4 and the bearing portions 19, 20.

(Modifications)

Modifications of the first embodiment are described below.

While the first embodiment is implemented such that the second bearing portion 20 is dislocated in an area axially rearward from a distal end of the abutment surface 18 and the mount aperture 22*a* has the cross sectional shape configured in the substantially semicircular shape, the seal member 23 may be made of a resilient body (of, for instance, rubber) formed in a simply cylindrical column in an event that the mount aperture 22*a* has a circular cross sectional shape, that is, when a whole of the mount aperture 22*a* is located in an area opposite to the engine (i.e., in the farther-from-engine side area). In such a case, hermetically inserting a cylindrical-column shaped seal member 23 to the mount aperture 22*a*, circular in cross section, enables foreign materials from entering a sliding clearance of the through-bore 22 from an outside, resulting in no probability of interrupting the movement of the intermediate gear 5 due to the presence of foreign materials while enabling smooth shift of the intermediate gear 5 on the intermediate shaft 4.

Second Embodiment

Figure 7:
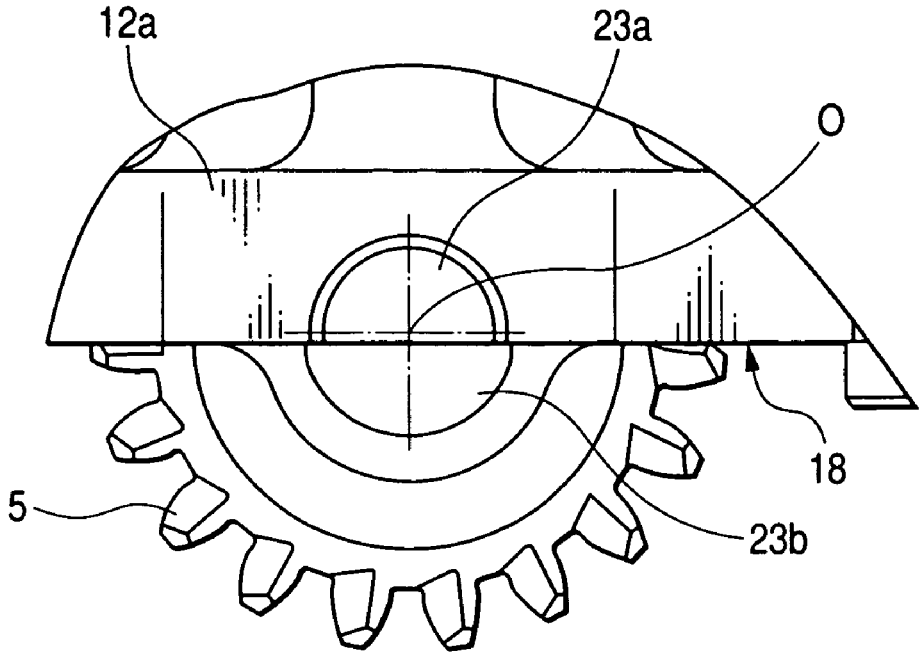
FIG. 7 is an axial front view showing a seal member, related to a second embodiment according to the present invention, under a mount condition.

Referring to FIG. 7, description is made of an intermediate geared starter of a second embodiment.

With the intermediate geared starter of the presently filed embodiment, the same component parts as those of the first embodiment bear like reference numerals and descriptions of the same are herein omitted or simplified.

With the second embodiment, as shown in FIG. 7, the through-bore 22 and the insertion bore 21 are formed such that a center "O" of the intermediate shaft 4 is positioned in an area far from the abutment surface 18 of the housing 12 in the farther-from-engine side area (on an upper side in FIG. 7). In this case, the mount aperture 22*a*, to which the seal member 23 is fitted, has an opening, exposed to the abutment surface 18, with a width (a width of the opening along a lateral direction in FIG. 7) less than an inner diameter of the through-bore 22. With such a structure, no probability occurs for the insert segment 23*a* to drop off from the mount aperture 22*a* downward in FIG. 7 after the insert segment 23*a* has been assembled to the mount aperture 22*a*, enabling the seal member 23 to be prevented from dropping off under a status (before or during assembling of the intermediate geared starter 1 to the engine) with the intermediate geared starter remaining in a single part.

Third Embodiment

Figure 8:
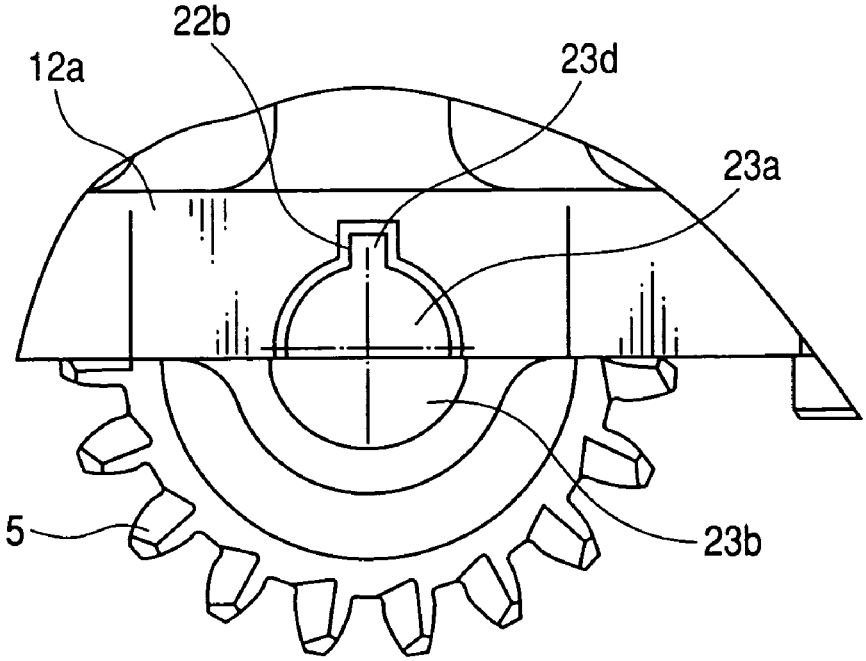
FIG. 8 is an axial front view showing a seal member, related to a third embodiment according to the present invention, under a mount condition.

Referring to FIG. 8, description is made of an intermediate geared starter of a third embodiment.

With the intermediate geared starter of the presently filed embodiment, the same component parts as those of the first and second embodiments bear like reference numerals and descriptions of the same are herein omitted or simplified.

The third embodiment takes the form of an example wherein a positioning device for the insert segment 23*a* is provided between the insert segment 23*a* of the seal member 23 and the mount aperture 22*a*.

As shown in FIG. 8, the positioning device is comprised of a protrusion 23*d*, formed on an outer periphery of the insert segment 23*a* in a convex configuration, and a recessed portion 22*b* formed on an inner periphery of the mount aperture 22*a* in a concave shape. During insertion of the insert segment 23*a* to the mount aperture 22*a*, the protrusion 23*d* of the insert segment 23*a* and the recessed portion 22*b* of the mount aperture 22*a* engage with each other in convexo-concave relationship, thereby enabling the insert segment 23*a* to be positioned with respect to the mount aperture 22*a*.

With the provision of such a positioning device, the insert segment 23*a* can be normally inserted to the mount aperture 22*a*, resulting in advantageous effects with no probability occurring for the seal member 23 to be mounted onto the housing in an inclined status while preventing a drop-off of the seal member 23 due to defective assembly.

Further, with a modification according to the presently filed embodiment, the positioning device may be implemented in a structure with an inverse tapered configuration, providing a capability of obtaining an advantageous effect of ensuring the prevention of a drop-off of the seal member 23. That is, the protrusion 23*d*, formed on the insert segment 23*a*, may take the form of an inverse tapered shape with a circumferential width gradually increasing along a height direction of the protrusion 23*d* and the recessed portion 22*b*, formed on the mount aperture 22*a*, may take the form of an inverse tapered shape with a circumferential width gradually increasing along a depth direction of the recessed portion 22*b*.

Upon engagement of the protrusion 23*d* and the recessed portion 22*b*, both of which are formed in the respective inverse tapered shapes, with each other in convexo-concave relationship, the insert segment 23*a* can be prevented from dropping off from the mount aperture 22*a*, because the protrusion 23*d* cannot be pulled out in the radially inward direction. Thus, a drop-off of the seal member 23 can be precluded under a status with the intermediate geared starter 1 remaining in a single part (prior to the assembly of the intermediate geared starter 1 to the engine).

Moreover, the presently filed embodiment may be combined with the structure of the second embodiment (wherein the center "O" of the intermediate shaft 4 is displaced in an area far from the abutment surface 18 (in the farther-from-engine side area)). In such a case, the drop-off of the seal member 23 can be more reliably prevented.

Fourth Embodiment

Figure 9:
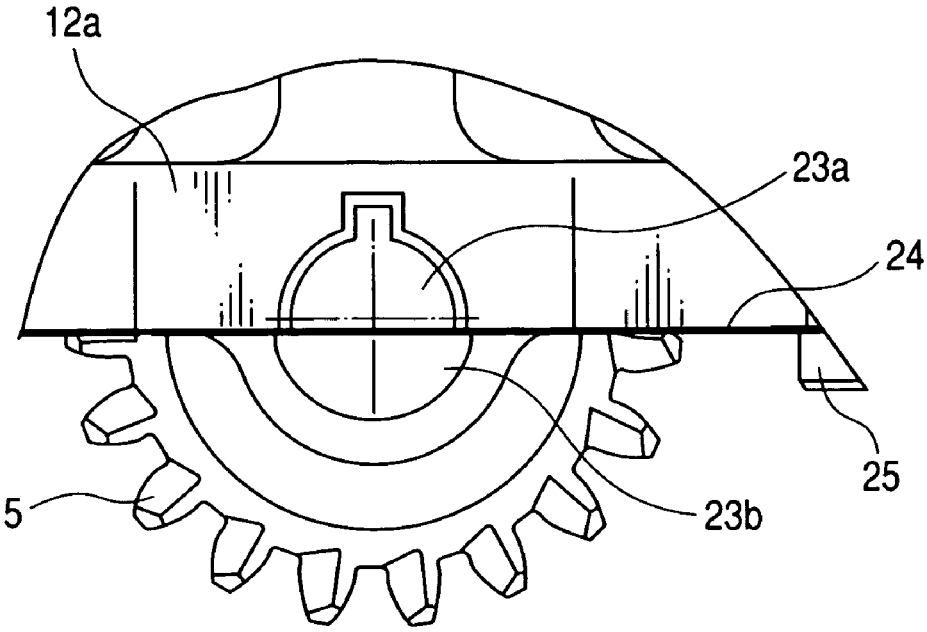
FIG. 9 is an axial front view showing a seal member, related to a fourth embodiment according to the present invention, under a mount condition.
Figure 10:
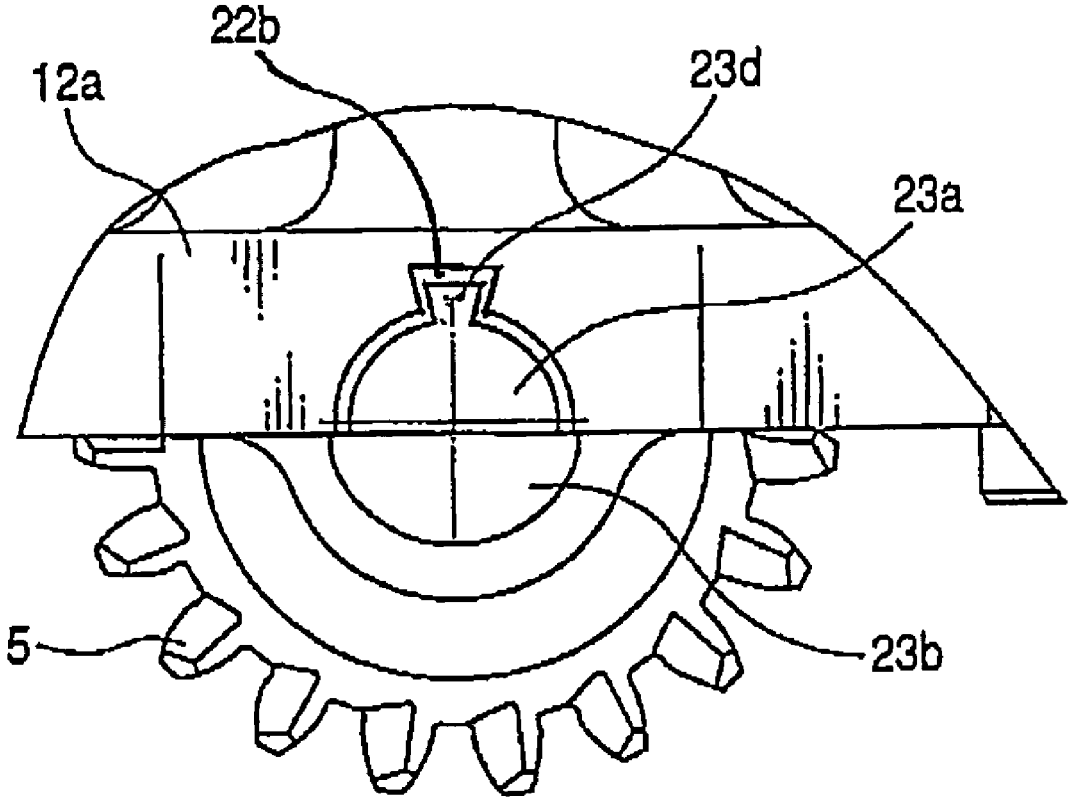
FIG. 10 is an axial front view showing a seal member, related of a modification according to the third embodiment according to the present invention, under a mount condition.

Referring to FIG. 9, description is made of an intermediate geared starter of a fourth embodiment.

With the intermediate geared starter of the presently filed embodiment, the same component parts as those of the first to third embodiments bear like reference numerals and descriptions of the same are herein omitted or simplified.

The fourth embodiment takes the form of an example that utilizes a gasket 24, disposed between the abutment surface 18 of the intermediate geared starter 1 and the mount surface 17 (see FIG. 4) of the engine, for preventing a drop-off of the seal member 23.

Upon mounting the seal member 23 onto the housing 12 and subsequently mounting the gasket 24 onto the abutment surface 18 (see FIGS. 3 and 4) in abutting engagement therewith as shown in FIG. 8, the gasket 24 enables the prevention of a drop-off of the seal member 23. Also, the gasket 24 may be formed with a plurality of positioning apertures (not shown) to each of which a positioning pin 25, protruding from the abutment surface 18, is fitted whereby the seal member 23 is fixedly positioned in place on the abutment surface 18. Moreover, the positioning pins 25 and the positioning apertures may be caused to engage with each other in slightly press fitting modes, enabling the prevention of a drop-off of the gasket 24 whereby a drop-off of the seal member 23 can also be avoided (prior to or during the assembly of the intermediate geared starter 1 to the engine).

The present invention may be embodied in several other forms without departing from the spirit thereof. The embodiments and modifications described so far are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. An intermediate geared starter comprising:

a pinion shaft rotatable in receipt of a rotational force from a motor;

a pinion gear supported on the pinion shaft;

an intermediate shaft disposed in parallel to the pinion shaft;

an intermediate gear, supported on the intermediate shaft in meshing engagement with the pinion gear at all times, which is axially moveable together with the pinion gear to be brought into meshing engagement with a ring gear of an engine to transfer the rotational force from the pinion gear to the ring gear via the intermediate gear for starting up of the engine;

a housing, formed with a through-bore for insertion of the intermediate shaft, by which one distal end of the intermediate shaft inserted to the through-bore is supported, the housing having (1) an abutment surface, to be brought into abutting contact with a mount surface of the engine, which is formed in parallel to the intermediate shaft, and (2) a bearing portion protruding toward the engine at a position displaced from a distal end of the abutment surface on a plane substantially perpendicular to the abutment surface; and a seal member provided on the housing to block a sliding clearance, created between the through-bore and the distal end of the intermediate shaft, at an outside of the starter;

wherein the through-bore is formed in the bearing portion so as to extend through the bearing portion from the abutment surface across an area straddling one side closer to the engine and another side opposing to the engine and is formed to have a mount aperture formed only in an area in a direction coming away from the engine, from between the bearing portion and a distal end of the housing to allow the seal member to be mounted in the mount aperture; and the seal member includes an insertion segment, adapted to be inserted into the mount aperture for hermetically sealing capability, and a tong segment, extending on a plane substantially perpendicular to the abutment surface, which is adapted to be brought into contact with an end face of the bearing portion, with the insertion segment and the tong segment being integrally formed of a resilient body for blocking the sliding clearance from outside.

2. The intermediate geared starter according to claim 1, wherein the tong segment of the seal member is tapered from the insert segment toward the end face of the bearing portion whereby when the insert segment is inserted into the mount aperture to a predetermined position thereof, the tong segment is resiliently brought into abutting contact with the end face of the bearing portion.

3. The intermediate geared starter according to claim 2, wherein the insert segment of the seal member is formed in a substantially half-column configuration, corresponding to a cross sectional shape of the mount aperture, and has a flat surface, exposed from the mount aperture, which is formed at the same height as that of the abutment surface with the seal member inserted into the mount aperture.

4. The intermediate geared starter according to claim 2, wherein the through-bore has a radial center dislocated from the abutment surface at a position in a direction coming away from the engine.

5. The intermediate geared starter according to claim 2, wherein:

the seal member has a protrusion formed on the insert segment at an outer periphery thereof; and an inner circumferential periphery of the mount aperture has a recessed portion with which the protrusion engages in convex-concave relationship.

6. The intermediate geared starter according to claim 5, wherein:

the protrusion, formed on the outer periphery of the insert segment, has an inverse tapered outer configuration with a circumferential width gradually increasing along a height direction of the protrusion; and the recessed portion, formed on the inner circumferential periphery of the mount aperture, has an inverse tapered outer configuration with a circumferential width gradually increasing along a depth direction of the recessed portion, the inverse tapered outer configuration of the protrusion engaging with the inverse tapered outer configuration of the recessed portion.

7. The intermediate geared starter according to claim 2, further comprising a gasket, mounted on the abutment surface, for preventing the seal member from dropping off.

8. The intermediate geared starter according to claim 1, wherein the insert segment of the seal member is formed in a substantially half-column configuration, corresponding to a cross sectional shape of the mount aperture, and has a flat surface, exposed from the mount aperture, which is formed at the same height as that of the abutment surface with the seal member inserted into the mount aperture.

9. The intermediate geared starter according to claim 8, wherein the through-bore has a radial center dislocated from the abutment surface at a position in a direction coming away from the engine.

10. The intermediate geared starter according to claim 9, wherein:

the seal member has a protrusion formed on the insert segment at an outer periphery thereof; and an inner circumferential periphery of the mount aperture has a recessed portion with which the protrusion engages in convex-concave relationship.

11. The intermediate geared starter according to claim 10, wherein:

the protrusion, formed on the outer periphery of the insert segment, has an inverse tapered outer configuration with a circumferential width gradually increasing along a height direction of the protrusion; and the recessed portion, formed on the inner circumferential periphery of the mount aperture, has an inverse tapered outer configuration with a circumferential width gradually increasing along a depth direction of the recessed portion, the inverse tapered outer configuration of the protrusion engaging with the inverse tapered outer configuration of the recessed portion.

12. The intermediate geared starter according to claim 10, further comprising a gasket, mounted on the abutment surface, for preventing the seal member from dropping off.

13. The intermediate geared starter according to claim 12, wherein the seal member is mounted in contact with the end face of the bearing portion inserted to the through-bore.

14. The intermediate geared starter according to claim 1, wherein the through-bore has a radial center dislocated from the abutment surface at a position in a direction coming away from the engine.

15. The intermediate geared starter according to claim 1, wherein:

the seal member has a protrusion formed on the insert segment at an outer periphery thereof; and an inner circumferential periphery of the mount aperture has a recessed portion with which the protrusion engages in convex-concave relationship.

16. The intermediate geared starter according to claim 15, wherein:

the protrusion, formed on the outer periphery of the insert segment, has an inverse tapered outer configuration with a circumferential width gradually increasing along a height direction of the protrusion; and the recessed portion, formed on the inner circumferential periphery of the mount aperture, has an inverse tapered outer configuration with a circumferential width gradually increasing along a depth direction of the recessed portion, the inverse tapered outer configuration of the protrusion engaging with the inverse tapered outer configuration of the recessed portion.

17. The intermediate geared starter according to claim 1, further comprising a gasket, mounted on the abutment surface, for preventing the seal member from dropping off.

18. The intermediate geared starter according to claim 1, wherein the seal member is formed to have a circular-column resilient body adapted to be press fitted to the through-bore to block the sliding clearance from an outside.

19. The intermediate geared starter according to claim 1, wherein the seal member is mounted in contact with the end face of the bearing portion inserted to the through-bore.

* * * * *